US007506874B2

(12) United States Patent
Hall

(10) Patent No.: US 7,506,874 B2
(45) Date of Patent: Mar. 24, 2009

(54) BLACKJACK GAME WITH PRESS WAGER

(75) Inventor: Geoffrey Hall, West Midlands (GB)

(73) Assignee: Shuffle Master, Inc, Las Vegas, NV (US)

( * ) Notice: Subject to any disclaimer, the term of this patent is extended or adjusted under 35 U.S.C. 154(b) by 72 days.

(21) Appl. No.: 11/582,821

(22) Filed: Oct. 18, 2006

(65) Prior Publication Data

US 2008/0012224 A1 Jan. 17, 2008

(51) Int. Cl.
*A63F 1/00* (2006.01)

(52) U.S. Cl. ..... 273/292; 273/294; 463/12

(58) Field of Classification Search ..... 273/274, 273/292, 309; 463/12, 13
See application file for complete search history.

(56) References Cited

U.S. PATENT DOCUMENTS 5,154,429 A 10/1992 LeVasseur
5,280,915 A 1/1994 Groussman
5,322,295 A * 6/1994 Cabot et al. ..... 273/292
5,328,189 A * 7/1994 Malek ..... 273/292
5,531,448 A 7/1996 Moody
5,615,888 A 4/1997 Lofink
5,636,842 A 6/1997 Cabot
5,685,774 A * 11/1997 Webb ..... 463/13
5,732,749 A * 3/1998 Fargeout ..... 139/383 AA
5,732,950 A 3/1998 Moody
5,810,360 A * 9/1998 Srichayaporn ..... 273/292
5,954,335 A * 9/1999 Moody ..... 273/292
6,012,719 A * 1/2000 Webb ..... 273/292
6,056,641 A * 5/2000 Webb ..... 463/13
6,217,024 B1 4/2001 Lofink
6,302,396 B1 10/2001 Eaton et al.
6,371,867 B1 * 4/2002 Webb ..... 473/292
6,406,023 B1 * 6/2002 Rowe ..... 273/292
6,481,717 B1 11/2002 Richardelle
6,481,719 B2 * 11/2002 Webb ..... 273/292
6,503,145 B1 * 1/2003 Webb ..... 463/16
6,776,416 B1 8/2004 Jackson
6,854,733 B2 * 2/2005 Webb ..... 273/292
6,868,074 B1 * 3/2005 Hanson ..... 370/328
6,959,927 B1 11/2005 Jacobs et al.
7,036,821 B2 * 5/2006 Hall ..... 273/292
7,175,180 B2 * 2/2007 Webb ..... 273/292
2003/0090063 A1 5/2003 Jarvis et al.
2003/0130032 A1 7/2003 Martinek et al.
2003/0218303 A1 11/2003 Walker et al.
2005/0051955 A1 3/2005 Schubert et al.
2005/0062226 A1 3/2005 Schubert et al.
2005/0242500 A1 11/2005 Downs (Continued)

*Primary Examiner*—William M. Pierce
(74) *Attorney, Agent, or Firm*—Mark A. Litman & Associates, P.A.

(57) ABSTRACT

A wagering game, preferably a variant of blackjack, is played by at least one player placing at least three separate wagers on a single round of the wagering game. A first of the three wagers is committed to a first hand wagering position, a second of the at least three wagers committed to a second hand wagering position, and the third wager initially is not committed to specifically either the first or second wagering position. From a first set of playing cards, the player receives a separate hand at each of the first hand wagering position and the second hand wagering position. The player commits the third wager to either the first hand wagering position or the second hand wagering position.

21 Claims, 2 Drawing Sheets

U.S. PATENT DOCUMENTS

2005/0288085 A1 12/2005 Schubert et al.
2005/0288086 A1 12/2005 Schubert et al.
2006/0063577 A1 3/2006 Downs et al.
2006/0084502 A1 4/2006 Downs et al.
2006/0183540 A1 8/2006 Grauzer et al.
2006/0288083 A1 12/2006 Ueda et al.
2007/0099686 A1 * 5/2007 Webb ..... 463/12

* cited by examiner

METHOD OF PLAYING A WAGERING GAME

BLACKJACK GAME WITH PRESS WAGER

BACKGROUND OF THE INVENTION

1. Field of the Invention

The present invention relates to the field of wagering, particularly wagering on gaming events, especially casino card table events, and the use of modified wagering and hand play formats in promoting the play of higher wager amounts in casino wagering, especially in the play of Blackjack or Twenty-One games.

2. Background of the Art

The objective of the well known casino table card game of "Twenty-One" is for a wagering player to finish a round of play with a hand of playing cards with a sum of the total value of cards coming as close as possible to the value of twenty-one, without the player hand total exceeding twenty-one. The game is played by one or more players against a dealer with the player making an initial wager on a final outcome under the rules of blackjack, which remain fairly consistent throughout the world, and with only minor variations in different casinos or jurisdictions. Players' hands that are less than or equal to twenty-one, and exceed the value of the dealer's hand wins. All players' hands that have a lower sum than the dealer's hand and all hands that exceed the sum of twenty-one lose. Dealer and Player hands with the same total value (without the player first busting, result in ties (called a "push"). An initial two-card hand totaling twenty-one points is called blackjack, and in the absence of the dealer having a similar hand, automatically wins, without respect to the dealer's hand final; count and is often paid at odds greater than 1:1.

One conventional method of playing Twenty-One uses one or more standard decks of playing cards (a fifty-two card deck without jokers). Each card is counted according to its face value (Jacks, Queens and Kings are worth 10) and Aces are worth either one (1) or eleven (11), depending on which is most beneficial to the count of the hand. The game begins by dealing two cards to each position where a player has made a wager. The dealer or house is also dealt two cards, usually with on card exposed to view.

A player views an initial value of cards in the player's hand, views the dealer's up-card (the exposed card) and then makes decisions on drawing or not drawing further playing cards. This further drawing is done in an attempt to try and win the hand by having a higher count than the dealer's hand without busting, or allowing the dealer to bust the house hand. The player can "stand" on any count of twenty-one or less. Once the player exceeds a count of twenty-one or "busts," the player wager is lost, whatever the ultimate point count of the dealer's hand. Usually, the dealer must hit when with a point count of less than seventeen. Normally a dealer must stand on a soft count of at least seventeen, a soft count being a hand value where an Ace is counted as a value of eleven. House rules may vary, however.

Although the game of blackjack or Twenty-one is a consistent winning game for the house, it is always desirable to entice players to increase the size of wagers so that the house wins more money on the house advantage. Players tend to place the minimum wager on a blackjack game unless the player is using some system or feels that the cards are running in a favorable streak.

Numerous methods have been considered for increasing the amount wagered by players on each hand or round of play in blackjack and other games. Side bets and jackpot wagers have been introduced, but these establish separate wagering pots or have their own distinct advantage and do not increase the amount of the wager on the underlying game. In fact, side bets tend to cause players to place minimum wagers because the odds in payouts are larger in the jackpot and side bet games, even if the frequency of wins may be less.

Other game designs have attempted to increase wagers from players on single rounds of play by providing players with multiple hands. This has been especially true in video blackjack games, with such disclosures as the following indicating the use of multiple players hands against a single dealer hand (e.g., U.S. Pat. Nos. 5,954,335; 5,531,448; and 5,732,950; and U.S. Patent Publication 20030090063) or multiple dealer hands (e.g., U.S. Pat. Nos. 6,959,927 and 5,154,429).

Other disclosures provide multiple player hands in live casino table blackjack game variants. These formats could also be used for video blackjack. Other formats of play vary the rules of the game to give an appearance of a differing relative advantage between a player and a dealer to attract larger wagers and longer play duration at the table.

U.S. Pat. No. 5,322,295 describes methods of playing card games wherein a player makes a plurality of wagers and is provided with an initial partial card hand for each wager. The player receives additional cards which the player assigns to the previously received initial partial hands. The supplemental cards provided to a player can be provided to the player all at once or one at a time. One specific method of play comprises the steps of: a) a player making at least two separate wagers; b) a dealer providing said player with at least one card for each wager made by said player and assigning said card to said wagers such that each wager has been assigned an initial partial hand; c) the dealer providing each player with a first supplemental card which said player may assign to one of said initial partial hands; and d) the dealer providing at least one additional supplemental card which the dealer assigns to an initial partial hand which has not yet been assigned a supplemental card by the player.

U.S. Pat. No. 5,615,888 (Lofink) describes a method of playing Twenty-One using a forty-eight card deck of cards comprising the Aces through Nines and Jacks, Queens and Kings. The elimination of only the four ten-spot cards (or any four cards having a numerical count of ten) makes card counting much more difficult for the professional card player. Preferably multiple decks, up to six decks, of these forty-eight card decks are used. The elimination of the four ten-spot cards tips the odds of the game toward the house. To make up for this difference and keep the game attractive to the players, the method of play is modified to provide liberal game rules and bonus payouts on the player's hand. The liberal game rules include allowing players to make double down wagers at any time regardless of the number of cards held by the player. Another rule allows the player to take back the amount of the player's double down wager if the player's numerical hand count does not exceed twenty-one and if the player is dissatisfied with his hand. A bonus is paid to a player if the player's first two cards are Blackjack regardless of the numerical count of the dealer's two cards. A winning hand is declared if the numerical count of the player's hand is twenty-one regardless of the numerical count of the dealer's hand.

U.S. Pat. No. 6,217,024 (Lofink) describes a method for providing a modified game of Twenty-One. The method includes removing player favorable cards from or adding player unfavorable cards to relative to a standard fifty-two card deck. To adjust the house advantage or vigorish as a result of the modification of the deck, the method of play is modified to provide one or more liberal game rules and bonus payouts on the player's hand. The combination of rule changes and deck modification can be used to approximately obtain a selected vigorish. The method of playing the game makes card counting much more difficult for the professional card player. Preferably multiple decks, up to six decks, of these modified decks are used.

U.S. Pat. No. 6,302,396 (Eaton et al.) describes a method of playing a wagering game with a deck of numerically valued cards includes the steps of having each player make an initial wager and dealing at least two cards to form a corresponding number of hands. Each player is asked to select an initial winning option based on how the player expects the hands to be dealt. The game further involves dealing an additional card to each of the hands until each of the hands has a count of at least a first predetermined value, such as seventeen in the case of blackjack. Any award is given to each of the players who correctly predicted how the hands would be dealt. The game method may also include the step of accepting a second wager from each of the players, simultaneously having each player who made the second wager select a second winning option based on how that player expects the hands to be dealt, and awarding the players whose second winning option correctly predicted how the hands would be dealt.

U.S. Pat. No. 6,481,717 (Richardelle) discloses a method of playing a card game by dealing a first hand consisting of a first predetermined number of cards. The method requires one or more players to elect whether or not to play a second hand. Each of the first hands are compared to determine whether or not they constitute a winning hand. A second hand consisting of a second predetermined number of cards is dealt. The first cards from the first hand are included in the second hand. Each of the second hands are compared using a predetermined ranking as a criterion for comparison to determine a winning hand. Each player who had a winning first hand and/or a winning second hand is then designated a winner. The first predetermined number of cards consists of two cards, and the first hand is played as a blackjack hand. The second predetermined number of cards consists of a number of cards, in addition to the cards drawn by each player for the blackjack hand, to make up a poker hand. Each player is required to place a bet before each step of dealing the first and second hands, and they are paid after the step of designating winning players. Such step of paying the winning player(s) includes the step of paying the winning player according to the odds set forth in a predetermined table depending upon the poker rank of the winning hand(s).

U.S. Pat. No. 6,776,416 (Jackson) describes a wagering game played with one or more standard decks of playing cards. Each deck comprises a) 52 cards or b) 48 cards without 10's. The method comprises: each player placing at least one wager to play in the game against a dealer; each player receiving two initial cards and the dealer receiving two initial cards; each player exercising optional rights to take additional cards, (hits) until the player stands with a point count of 21 or below. Alternatively, each player exercises optional rights to take additional cards until a point count in a player's hand exceeds a point count of 21. The player's hand remains in-play even after a point count in excess of 21 is obtained. The dealer takes hits according to conventional rules of blackjack so that the dealer total count according to the rules reaches at least a soft 17, at least a hard 17, or a count in excess of 21. If both the player's hand and the dealer's hand exceed a point count total in excess of 21, rules determine whether the player's hand wins, ties or loses against the dealer's hand. Hands of 21 or under always wins over a bust hand. In ties of point counts of 21 and/or below, either convention rules or special rules determine whether the dealer wins or ties the player's hand. In addition, the player may receive in excess of 3:2 for a blackjack.

U.S. Pat. No. 7,036,821 (Hall) describes a card game with a set of playing cards and a gaming cloth (10), the gaming cloth (10) defining an area (12) in which a dealer may deal two or more cards constituting a house hand, and a plurality of player areas. Each player area includes an area (14, 16) in which two or more hands comprised of two or more cards may be dealt to a player; areas (18, 20) corresponding to each hand for placing a bet on the hands beating the house hand; and an area (22) in which optional bets may be placed on the matching of the cards dealt to each player to specified hands. The game may provide multiple hands to a player, and a wager in addition to the wagers on each of the two hands.

U.S. Pat. No. 5,636,842 (Cabot) describes methods of playing card games. A dealer initially provides a dealer hand with a number of cards exceeding the minimum number required to play a hand. According to various embodiments, the dealer discards the excess cards during the play of a card hand. This reference is one method of shifting rules of play to increase house advantage.

U.S. Pat. No. 5,280,915 (Groussman) describes a method of playing a blackjack game that enables a blackjack player to make a second initial wager and play a second initial hand on any deal of the cards. The layout of the table includes boxes on each player station where the wagers are placed, and card dealing areas next to each of the boxes where the hands of cards are dealt. With this layout, the dealer and player can clearly determine which cards belongs to the player's first wager and which cards belong to the player's second wager.

U.S. Patent Publication No. 20030218303 describes a method and apparatus of playing a game. The game provides a player with at least one option for playing at least one round of the game in accordance with at least one advantage and/or disadvantage. For example, a player may agree to play a current round of play and/or at least one future round of play in accordance with a revised rule.

Alternative and more effective methods of increasing wager size and frequency in casino table and video or internet blackjack games are still desired. The new methods described herein may be used as a distinct game or combined with the technologies already known in the art, to which end all of the references described herein are incorporated herein by reference.

SUMMARY OF THE INVENTION

A Player places at least three wagers on the table, a first wager for a first hand, a second wager for a second hand and a Press wager. At least two separate Player hands, such as blackjack hands are dealt. The Player reviews the at least two hands and moves, shifts or places the Press wager to one of the two Player hands. The game then proceeds as with regular blackjack rules applying to each of the at least two player hands. A modified deck of cards, and/or other rule modifications may be used to shift the underlying game advantage towards the house. For example, the player may lose his press bet when the initial four cards are of the same color.

DETAILED DESCRIPTION OF THE INVENTION

Figure 1:
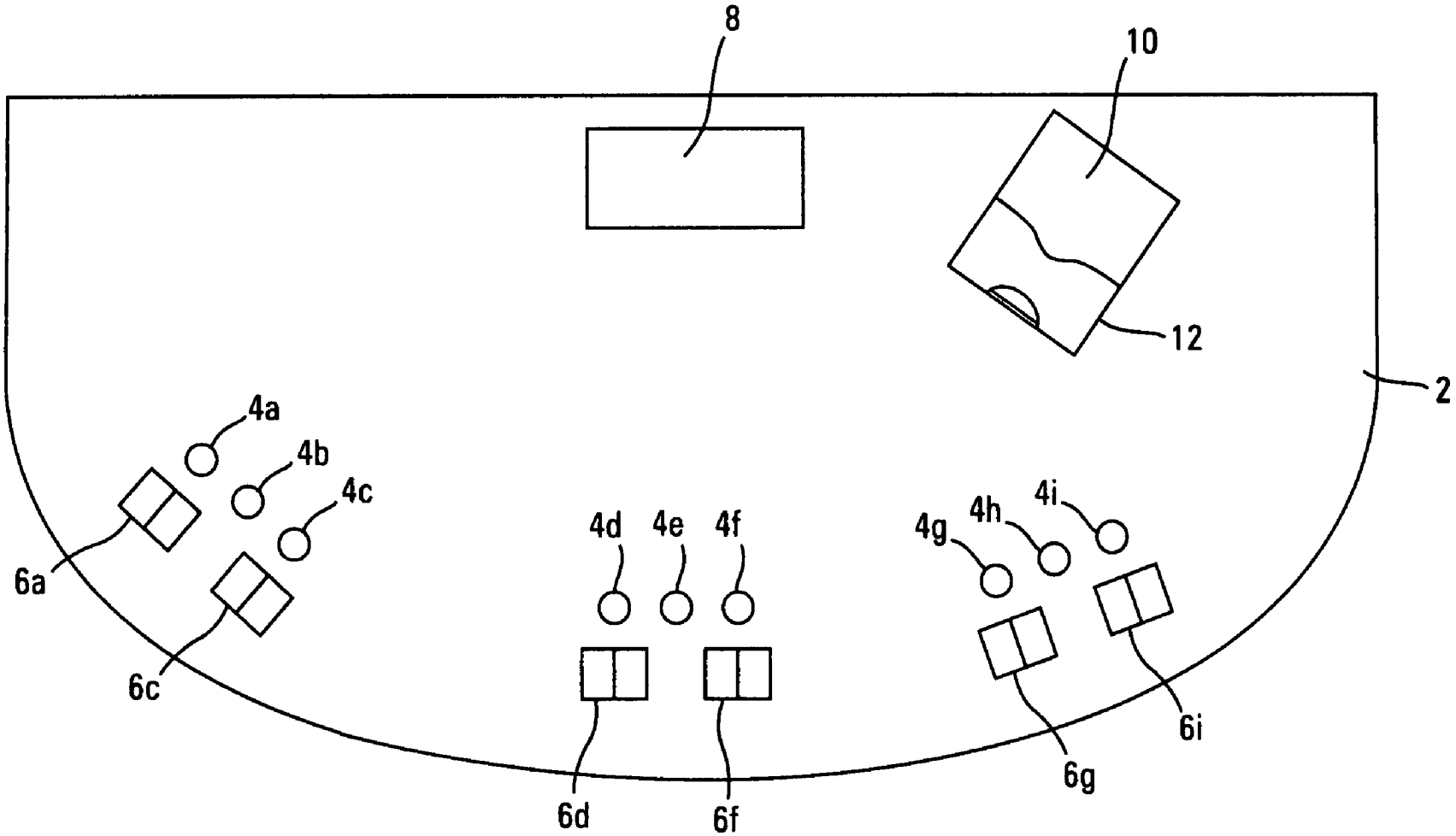
FIG. 1 shows a table layout designed for use with the game technology described herein.
Figure 2:
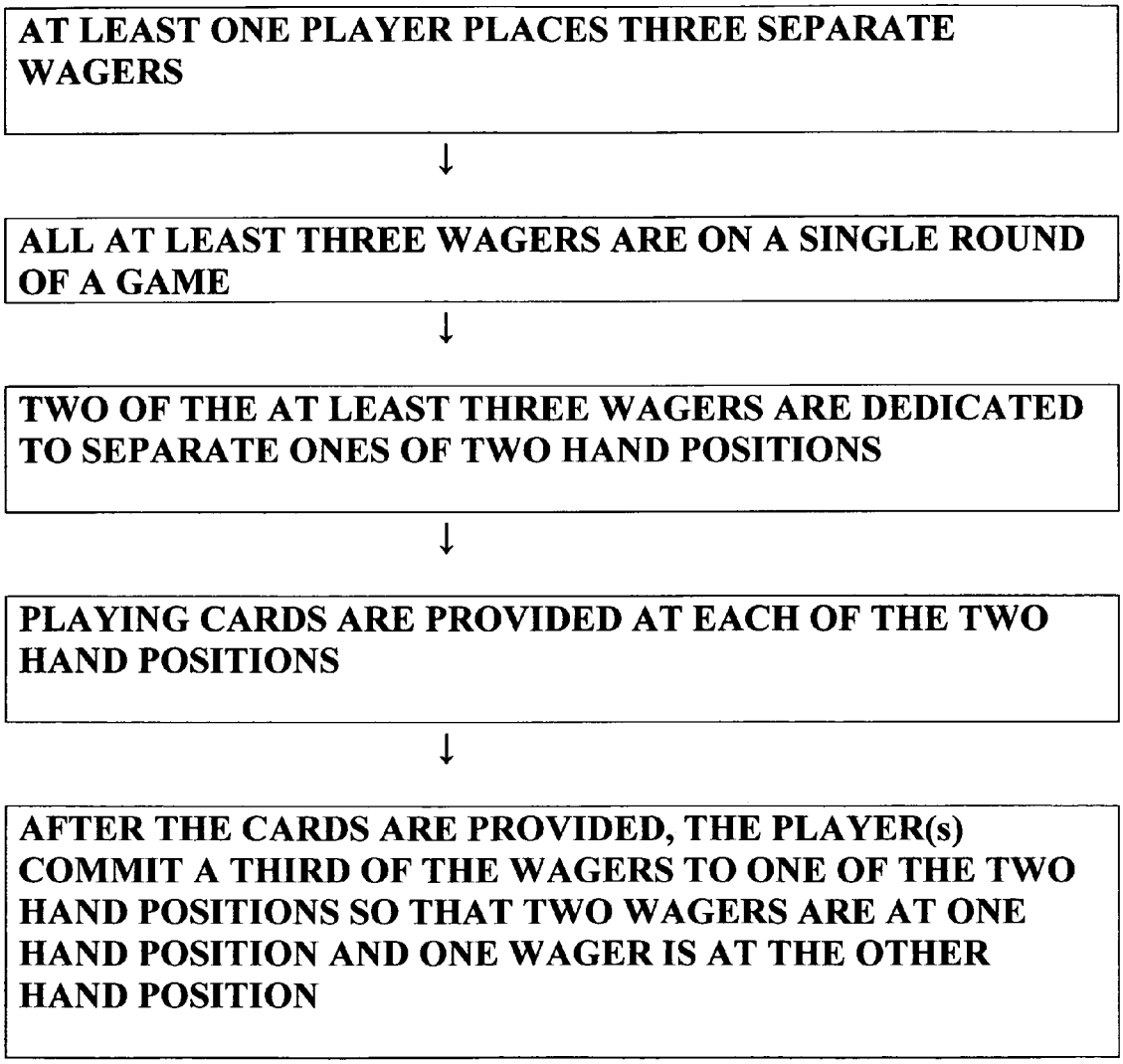
FIG. 2 shows a flow diagram of process steps that may be used in practicing technology described herein.

A table construction and a method of playing a wagering game comprises an underlying game of blackjack in which at least one player plays against a dealer hand. The at least one player places at least three separate wagers on a single round of the wagering game. A first of the three wagers is committed to a first hand wagering position. A second of the at least three wagers is committed to a second hand wagering position. A third wager is committed to the game that is not committed to specifically either the first or second wagering position. From a first set of playing cards, the player receives a separate hand at each of the first hand wagering position and the second hand wagering position. After viewing the cards, the player allocates the third wager to either the first hand wagering position or the second hand wagering position. The allocation may be completely at the direction of the player or may be controlled or partially controlled by rules associated with the game. Assuming a minimum required wager in blackjack, this game will require as much as three minimum wagers to play the game.

An attractive feature that would appear to justify the third wager is the ability of the player to redistribute committed wagers after a partial view of at least one of the dealer's partial hand and a complete view of both player hands. The advantages of this option can seem very attractive to a player, giving the player an opportunity to increase the distribution of wagers towards better hands.

In the play of the game, a dealer hand is provided from the first set of playing cards (typically a 52 card standard deck), and at least one of the first hand and the second hand is played against the dealer hand to determine an outcome to resolve at least one of the at least three wagers. Usually both hands may be played, although a surrender option might be available on either or both player hands. The at least three wagers may be equal wagers. The player may have absolute discretion on where the third wager is to be placed as between the first and second hands. When the wagers are not equal, certain restrictions may apply as to where the larger wager is to be distributed between the first wagering position and the second wagering position. The rules may also put restrictions on placing the press bet even when the bets are all equal in amount. For example, when there is a blackjack in one of the two player hands, the rules may require that the third wager be shifted to the non-blackjack hand or withdrawn by the player, or even declared an automatic loss.

It might be desirable in some instances to increase the house advantage in the underlying game. The first set of playing cards may comprise or consist of one or more decks of playing cards from which cards have been removed or to which cards have been added to provide an increased advantage to the dealer hand in competition against at least one of the first hand and the second hand. For example, some or all tens (or cards of value of 10, may be removed from the first set of playing cards. Similarly, 9-value cards or other cards favoring the player when rich in the cards may be removed. Also, cards that favor the dealer, such as 2s, 3s, 4s and 5s, may be added to the first set of cards. Such cards favor the dealer because the dealer cannot bust when receiving any of these cards. The dealer may take hits up to a maximum of 16 points in the dealer hand, and the highest card from this series providing a final count of 21.

Another preferred method of increasing the house advantage is to place conditions on winning the press bet and conditions on when the bet must be pressed.

In one example of the invention, the player must receive four cards of at least two different colors to qualify to press the bet. If the player receives 4 cards of the same color, the press bet is automatically lost to the house. In other forms of the game, if the player receives 4 cards of the same suit, all three bets are lost to the house. If the player receives four cards of the same suit in order (a straight flush), or other conventional poker hand, the player may lose the press bet but win an automatic bonus.

Each of the rules that place restrictions on keeping the press bet in play, will increase the house advantage.

Another mechanism for increasing house advantage is to reduce the payout odds on certain winning hands. For example, the house may pay 1:1 odds on player blackjacks rather than the conventional 3:2 payout odds.

In another example, a dealer's hand final count of 22 may be declared an automatic push. The rule that all hands where the dealer's final count in a hand of blackjack is 22 is a push in the wagering game is a preferred embodiment. The following descriptions, using actual examples of play of the game, will help further describe the scope of the technology and the rules of play.

EXAMPLES

In these examples, two-deck, four-deck, six-deck or eight-deck sets of playing cards are used in the play of the underlying blackjack game, those being the generally preferred numbers of decks used by casinos, but the game described herein not necessarily being to those specific numbers.

Before any playing cards are dealt, each player must place three distinct wagers on the gaming table. A typical design for a gaming table 2 to be used with the present system is shown in FIG. 1, which for simplicity is shown with only three player positions. At a player position to the far left of the table are shown three wagering positions 4*a*, 4*b* and 4*c* for the left hand wager, press wager and right hand wager, respectively. Again for simplicity, the three wagers placed must be the same value (e.g., each is $5.00, each is $10.00, etc.). It is also possible to require that the press wager be at least as large as the largest wager committed to a hand, or to be less than the largest wager, when the two wagers (e.g., 4*a* and 4*c*) are of different values. The two other players are also shown with three separate wagering positions, 4*d*, 4*e* and 4*f* for the middle player and 4*g*, 4*h* and 4*i* for the right hand player. After the wagers have been received, two hands of two playing cards are dealt to each of the players (6*a* and 6*c* to the left hand player, 6*d* and 6*f* to the middle player and 6*g* and 6*i* to the right hand player) making the wagers and one hand of two playing cards is dealt to the dealer at 8. For convenience, the cards are shown being delivered from a shuffler 10 with a front end shoe 12. Playing card reading technology, bet sensing, event determination, game recording, player strategy analysis, and the like my be performed through the use of advanced technology such as that disclosed in U.S. Patent Publications 20060183540; 20060084502; 20060063577; 20050288086; 20050288085; 20060288083; 20050242500; 20050062226; 20050051955; and 20030130032 which are incorporated herein by reference in their entirety.

Example 1

In this example, all wagers must be equal and standard rules of blackjack control the game play. Six decks of standard 52-cards each are used.

Player 1 receives two hands of 3♠ 7♣ and J♥ 6♦.

Player 2 received two hands of 10♠ 9♥ and 9♦ 8♠.

Player 3 (the right hand player) received cards of 2♠ 6♠ and 10♥ 3♦.

The dealer shows an 8♠.

Player 1 would likely shift the $5.00 press wager to the 3♠ 7♣ (even if he chooses to double down on the next card), putting a total of $10.00 at risk on that hand. Player 2 would shift the press wager to the 10♠ 9♥ and stay on that hand, placing $10.00 at risk on that hand. Player 3 would likely shift the press wager to the 2♠ 6♠ and take hits on that hand, having $10.00 at risk on the 2♠ 6♠ hand. Each of the two player hands would be played to their conclusion against the single dealer hand according to accepted rules for Twenty-One.

Example 2

In this example, the player must make the Press wager equal to twice the minimum wager of one of the two hand position wagers made by the player.

Player 1 has wagered $5.00 on each hand and a $10.00 Press wager and receives two hands of Q♠ 7♣ and J♥ 6♦. Player 1 would shift the Press wager to the Q-7 hand, which has the highest likelihood of success.

Player 2 has wagered $5.00 on the left hand, $10.00 on the right hand and a $10.00 Press wager and received two hands of 10♠ Ace♥ and 9♦ 8♠. In this example, the house rules prohibit pressing the wager to a blackjack hand, so the press wager is assigned to the 17 value hand.

Player 3 (the right hand player) has placed wagers of $10.00 on the left hand and $5.00 on the right hand and a $10.00 Press wager and has received cards of 5♠ 6♠ and K♥ 10♦. A conservative player would shift the Press wager to the K-10 hand, assuming a highly probable win, and an aggressive player would shift the Press wager to the 5-6 hand with a count of 11, and double down on the hand because of the displayed dealer's card. (The dealer shows a 6♠).

Example 3

In this example, all wagers must be equal and the standard rules of blackjack are modified in control the game play such that a dealer final count of twenty-two (22) forces a tie on all player hands except for a blackjack or a bust. The same hands and dealer cards as in Example 1 are dealt again.

Player 1 receives two hands of a) 3♠ 7♣ and b) J♥ 6♦.

Player 2 received two hands of c) 10♠ 9♥ and d) 9♦ 8♠.

Player 3 (the right hand player) received cards of e) 2♠ 6♠ and f) 10♥ 3♦.

The dealer shows an 8♠.

Hand 1*a*) is hit to reach a final count of 20 and hand 1*b*) busts. Hand 2*c*) stands pat at 19 and hand 2*d*) stands pat at 17. Hand 3*e*) hits to 18 and hand 3*f*) hits to a bust. The dealer takes 2 hit cards for a total count of 22. As a result of this play, hands 1*a*), 2*c*), 2*d*) and 3*e*) push, while hands 1*b*) and 3*f*) lose, because they busted before the dealer hand reached twenty-two.

Example 4

In this example, an original set of four 52-card decks has had all 10s removed from the deck to increase the house advantage. In addition, according to the rules of the game variant, the Press wager must be shifted to a pat hand (a hand with a value of 17 or more, and if there are two hands with values of 17 or more, the rules may require the Press wager to be committed to the higher or the lower value). This is done to limit double downs with an increased wager (because of the shift of the Press wager).

Example 5

In this form of the game, players lose their press wager when the first four cards are of the same color. Four standard decks of cards are used. The first player receives the following 4 cards, face up: A♥, 5♥ and K♦, J♥. The player makes three equal $5.00 bets. The press bet is automatically lost because the player received four red cards, "coloring out".

The second player makes three equal $5.00 wagers and receives the following hand: 2♥, 3♣, 4♠, and 5♦. He has not colored out, but has achieved a "straight" poker hand. The player is paid a bonus of 1:1 on his press bet. The player then presses his bet to the 4-5 hand and play continues.

The third player makes three equal bets of $10.00 each. He receives the following four cards: 9♠, 10♥, Q♠ and 3♦. He presses his bet to the 9-10 hand and $20.00 remains at risk on the 9-10 hand, and $10.00 remains at risk on the Q-3 hand.

Example 6

In this example, player 1 is required to press his wager early if the first 2 or 3 cards dealt to the player are the same color. For instance, the player places three equal $5.00 wagers and received an A♥ and 4♦ as the first card going to each hand. Since the cards are of the same color (red), the player is forced to press the third bet without the benefit of seeing his extra card or the dealer card. The player presses to the A♥ hand.

Player 2 receives a 4♣/6♠ and 8♥ in the first two hands. Before receiving a fourth card, player 2 is required to press his press wager. He presses to the 4/6 hoping for an Ace or face card. Play then continues.

Although the game has been emphasized as a casino table game, it may be played as a video game, as a multiplayer platform or on the internet. Other variations, equivalents or alternatives may be used within the generic concepts of the described game technology. The underlying game may be blackjack, baccarat, acey-deucy, poker, Hold 'Em poker, or other games in which there tends to be even money wagers on a hand (e.g., with a maximum payout at 2:1 odds). This is desirable to avoid transfer of wagers to hands where large odds may be paid as a guarantee on a hand (e.g., Three-Card Poker® games) and would greatly alter the house hold.

The invention claimed is:

1. A method of playing a wagering game comprising:

at least one player placing at least three separate wagers on a single round of the wagering game, with a first of the three wagers committed to a first hand wagering position, a second of the at least three wagers committed to a second hand wagering position, and a third wager that is not committed to specifically either the first or second wagering position;

from a first set of playing cards, the player receiving a separate hand at each of the first hand wagering position and the second hand wagering position; and the player committing the third wager to either the first hand wagering position or the second hand wagering position.

2. The method of claim 1 wherein a dealer hand is provided from the first set of playing cards, and at least one of the first hand and the second hand is played against the dealer hand to determine an outcome to resolve at least one of the at least three wagers.

3. The method of claim 1 wherein a dealer hand is provided from the first set of playing cards, and both the first hand and the second hand are played against the dealer hand to determine an outcome to resolve all of the at least three wagers.

4. The method of playing the wagering game of claim 1 wherein the at least three wagers are equal wagers.

5. The method of claim 3 wherein the player has absolute discretion on where the third wager is to be placed as between the first hand wagering position and the second hand wagering position.

6. The method of claim 1, wherein the third wager is committed to a first hand or a second hand after viewing the player hands.

7. The method of claim 1, wherein the third wager is committed to a first hand or a second hand after viewing the player hands and a dealer up card.

8. The method of claim 2 wherein standard blackjack rules are used to determine game outcome except that when the dealer's final count in a hand of blackjack is 22, the player hands push.

9. The method of claim 2 wherein the player commits the first wager, the second wager and the third wager to a game of blackjack.

10. The method of claim 1, wherein prior to the player committing the third wager, the wager must qualify to stay in play by the player receiving at least two different color cards between the cards received in the first and second hands.

11. The method of claim 10, wherein the player receives 4 cards before the qualification step.

12. The method of claim 1, wherein the third wager is committed as soon as at least two player cards of the same color are dealt to a player.

13. The method of claim 12, wherein the third wager is committed after three cards of the same color are dealt to a player.

14. The method of claim 2, wherein blackjack rules are used to determine game outcome, except player blackjacks are paid 1:1.

15. The method of claim 1, wherein plural standard decks of 52 cards are used to play the game.

16. The method of claim 1, wherein players commit the third wager to a lower ranking hand.

17. The method of claim 1, wherein players commit the third wager to a higher ranking hand.

18. A method of playing a wagering game, comprising:

each player placing three wagers, a first wager on a first blackjack hand, a second wager on a second blackjack hand, and a press wager;

the dealer dealing two two-card hands to each player and one two-hand to the dealer;

each player viewing at least his cards and electing to press the third wager to a first or a second hand; and resolving the hands according to the rules of blackjack.

19. The method of claim 18, wherein the third wager is forfeited when each of the four initial cards is of the same color.

20. The method of claim 18, wherein the first three wagers are equal.

21. A method of playing a single wagering game, comprising:

each player placing a mandatory three wagers on a single round of play of the single wagering game, a first wager on a first blackjack hand, a second wager on a second blackjack hand, and a press wager;

the dealer dealing two two-card hands to each player and one two-hand to the dealer;

each player viewing at least his cards and electing to press the third wager to the first blackjack hand or the second blackjack hand; and resolving the first blackjack hand and the second blackjack hand and all three wagers placed thereon according to the rules of blackjack.

* * * * *